United States Patent [19]

Robinson

[11] Patent Number: 4,476,986

[45] Date of Patent: Oct. 16, 1984

[54] EASEL DEVICE FOR DISPLAY SHELF

[75] Inventor: E. Montgomery Robinson, Chattanooga, Tenn.

[73] Assignee: Atlas Paper Box Company, Chattanooga, Tenn.

[21] Appl. No.: 307,429

[22] Filed: Oct. 1, 1981

[51] Int. Cl.[3] ..... A47F 5/00

[52] U.S. Cl. ..... 211/134; 211/184; 248/465.1

[58] Field of Search ..... 211/134, 45, 50, 51, 211/11, 184; 248/460, 441 R, 346, 465.1; 108/61

[56] References Cited

U.S. PATENT DOCUMENTS

| | | | |
|---|---|---|---|
| 466,969 | 1/1892 | Wells | 211/189 X |
| 771,467 | 10/1904 | Eckart | 248/460 |
| 2,062,802 | 12/1936 | Walker | 211/11 X |
| 2,649,093 | 8/1953 | Rigney | 211/50 |
| 3,305,102 | 2/1967 | Saphirstein | 211/184 |
| 3,669,278 | 6/1972 | Heroy | 211/184 |
| 4,364,481 | 12/1982 | Ricci | 211/153 X |

FOREIGN PATENT DOCUMENTS

| | | | |
|---|---|---|---|
| 1091791 | 11/1954 | France | 248/465.2 |

*Primary Examiner*—William E. Lyddane
*Assistant Examiner*—Peter A. Aschenbrenn
*Attorney, Agent, or Firm*—Harrington A. Lackey

[57] ABSTRACT

An easel device for assembly with a display shelf panel having a plurality of peg holes, in which the easel device includes downward diverging front and rear support members, preferably made of elastically yieldable wire members and having downward and forward projecting peg elements for insertion into corresponding peg holes in the shelf panel to support a planar article, such as a book, in an upright inclined position upon the shelf panel. The shelf panel is further characterized by transverse ribs spaced in front of the peg holes receiving the peg elements of the front support members to support the planar article between the front support member and the rib member. The shelf panel may also include transversely spaced downward projecting bearing ridge members, or downward projecting bearing pads adapted to be adhesively secured to the top surface of the supporting shelf. The shelf panel may also be provided with transverse severance grooves for the severance of the excessive portions of the panel to accommodate supporting shelves of different depths.

8 Claims, 6 Drawing Figures

EASEL DEVICE FOR DISPLAY SHELF

BACKGROUND OF THE INVENTION

This invention relates to shelf support devices, and more particularly to an easel device for assembly with a display shelf.

It has been the custom in displaying various types of stationary, school supplies, and other paper products, including composition books, notebooks, and writing tablets, to lay these products flat on vertically spaced shelves for display to the public.

Sometimes planar paper products such as composition books are arranged in a vertical or inclined attitude by use of various types of plastic or wire holders or partitions. Examples of some of these prior art wire support members or partitions for use on perforated shelving are disclosed in the following U.S. patents:

U.S. Pat. No. 2,933,195, Radek, Apr. 19, 1960,

U.S. Pat. No. 3,305,102, Saphirstein, Feb. 21, 1967.

Both the Radek and Saphirstein patents disclose partition members made of wire having depending pegs for insertion into a peg holes in a shelf to maintain the wire devices in substantially vertical planes. These partition members function primarily to define storage spaces for supporting or separating various articles, some of which may engage the vertical partition members. However, neither Radek nor Saphirstein disclose an easel type device particularly adapted for supporting composition books and other planar type paper articles for better display of the articles.

SUMMARY OF THE INVENTION

The shelf support device made in accordance with this invention includes an easel-type body member haing downward diverging front and rear support members including depending peg elements for insertion into corresponding peg holes in a shelf member or shelf panel to support a planar article, such as a composition book, upon the shelf panel in a substantially upright, slightly rearwardly inclined, operative position.

The front and rear panels are preferably integral and made of elastically yieldable material to facilitate insertion of the peg elements into the peg holes and to maintain a tight fit between the peg elements and the peg holes.

In the preferred form of the invention, an easel device is formed of a pair of transversely spaced inverted V-shaped wire members, the lower end portions of which constitute forward projecting peg elements for insertion into and retention by the peg holes of a perforated shelf member. The inverted integral wire members are secured together only by a rear transverse rod fixed to the lower portions of the rear legs of the wire members and in a position to engage the top surface of the shelf member when the easel device is inserted into its operative position in the shelf member.

The particular shelf member is preferably a relatively thin, thermoplastic shelf panel molded into panel sections for support upon an existing shelf. The panels are perforated so that there are a plurality of transversely and longitudinally spaced peg holes adapted to receive the peg elements of a plurality of the easel devices. The shelf panel is preferably provided with upwardly projecting rib members spaced in front of the peg holes receiving the front peg elements of the wire members and thereby providing a recess or pocket between the front legs of the wire members and the adjacent rib member for receiving the lower edge of the planar article, such as a composition book.

The shelf panel is also preferably provided with transversely spaced, longitudinally extending ridge members having substantially coplanar bottom bearing surfaces for supporting the shelf panel upon an existing supporting shelf. Downward projecting bearing pads may be formed in the shelf panel, not only to provide additional bearing support for the shelf panel, but also to provide a surface secured to a double-faced adhesive pad for securing the shelf panel to the underlying shelf.

Severance grooves are preferably formed transversely the full width of each of the panel sections adjacent the rear portion thereof, to permit cutting off rear panel portions of excessive depth so the panel section may fit the particular underlying shelf.

The shelf panels are provided with front depending flanges which may engage the front edge of an underlying supporting shelf to properly locate the shelf panel relative to the shelf, and also to cover and hide the front edge of the supporting shelf.

The easel device may be easily inserted and removed from any group of peg holes in the shelf panel to afford versatility in the support of different types of planar articles in different positions for varying display effects and needs.

DESCRIPTION OF THE PREFERRED EMBODIMENTS

Figure 1:
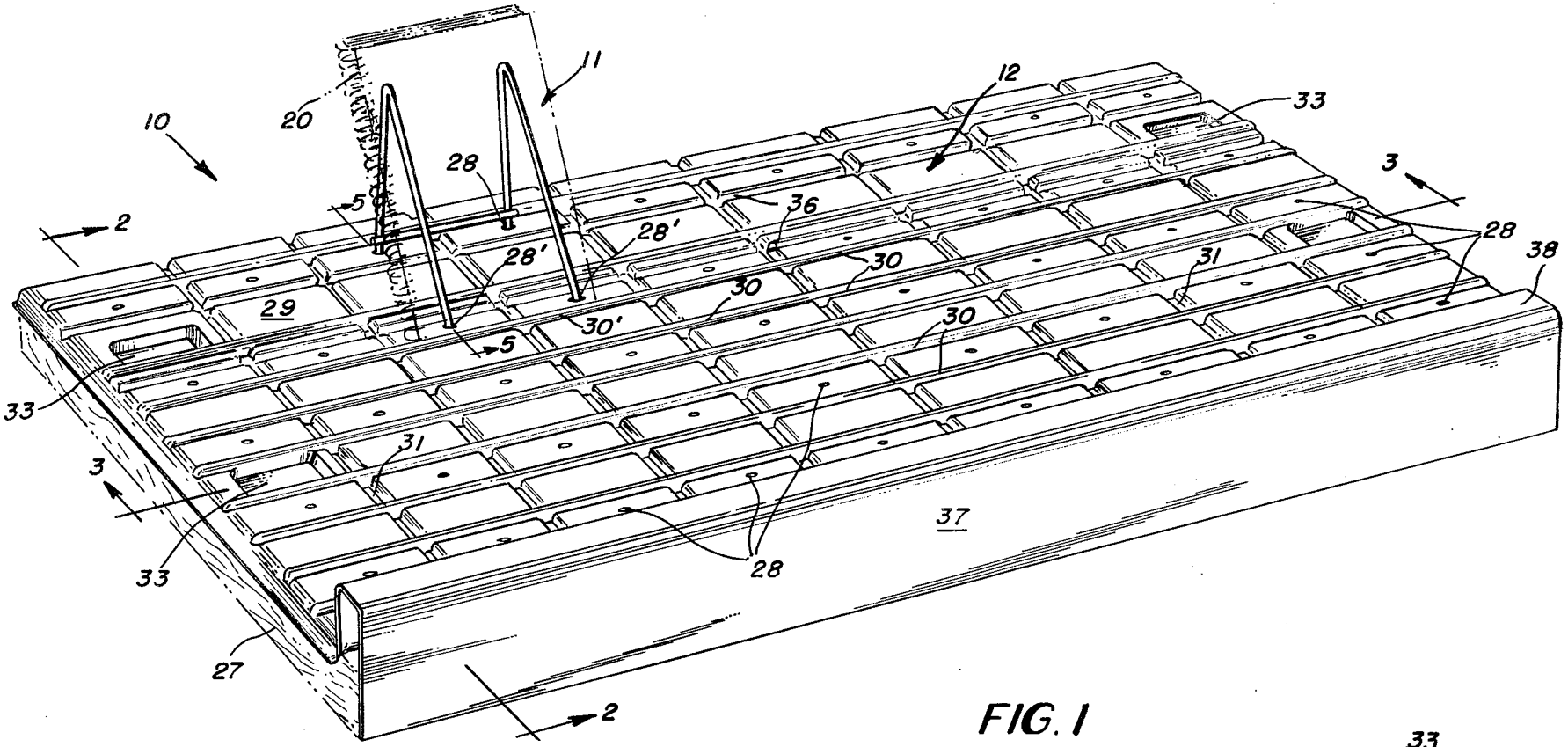
FIG. 1 is a top front perspective view of a shelf panel section made in accordance with this invention, mounted upon an underlying supporting shelf, and illustrating one of the easel devices, in operative position upon the shelf panel, supporting a composition book disclosed in phantom.
Figure 2:
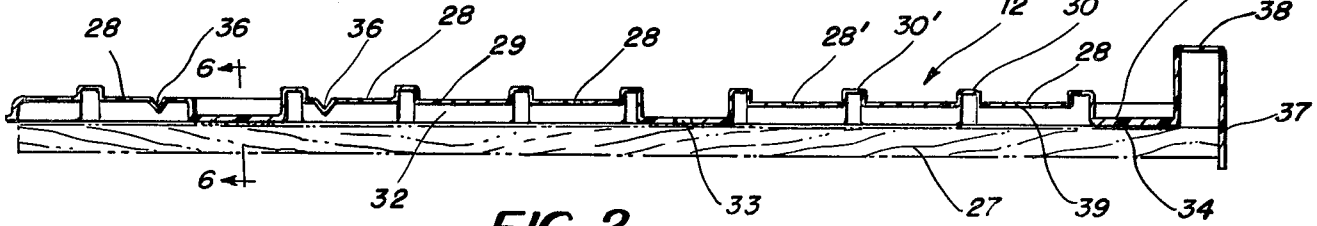
FIG. 2 is an enlarged section taken along the line 2—2 of FIG. 1, with the easel device removed.
Figure 3:
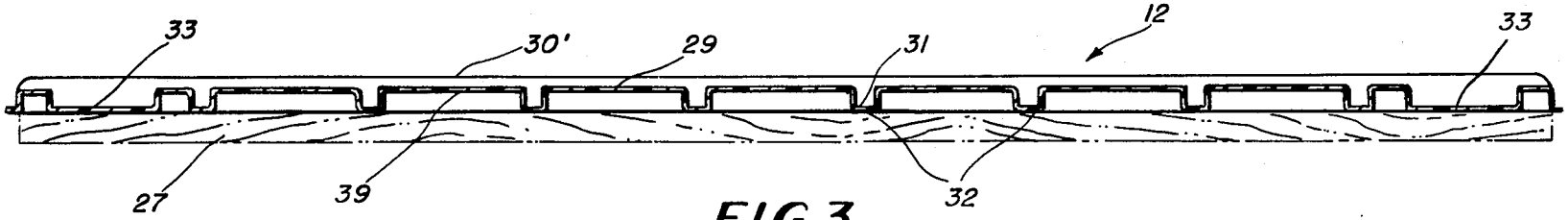
FIG. 3 is a section taken along the line 3—3 of FIG. 1, with the easel device removed.
Figure 6:
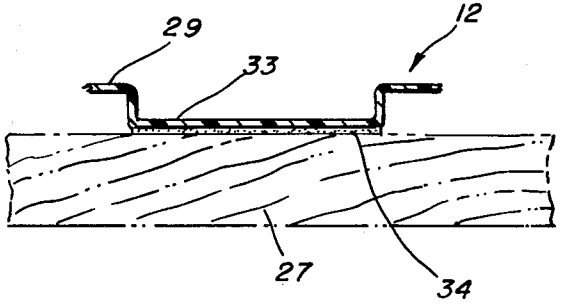
FIG. 6 is an enlarged fragmentary section taken along the line 6—6 of FIG. 2.

Referring now to the drawings in more detail, FIG. 1 discloses a shelf support assembly 10 made in accordance with this invention including an easel device 11 supported upon a shelf panel 12.

Figure 5:
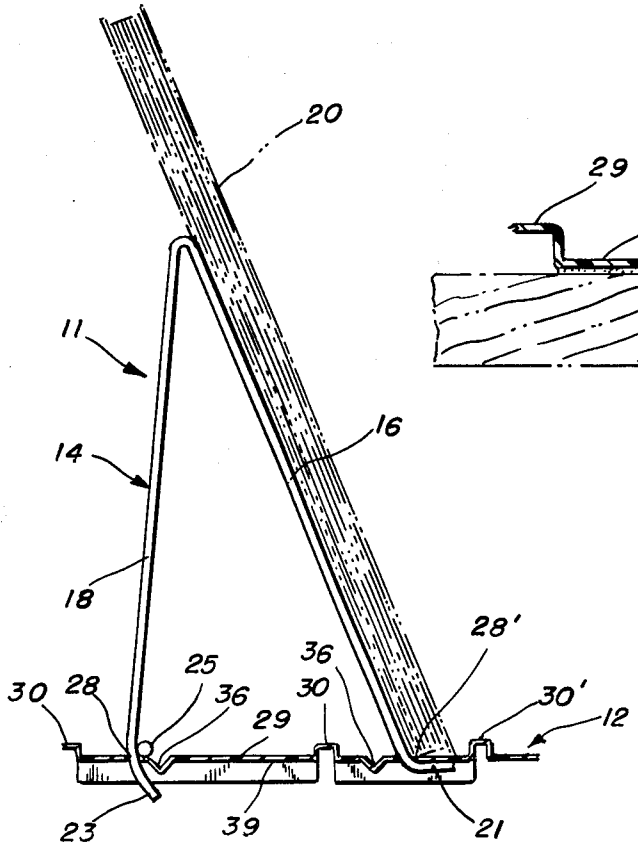
FIG. 5 is an enlarged fragmentary section taken along the line 5—5 of FIG. 1.
Figure 4:
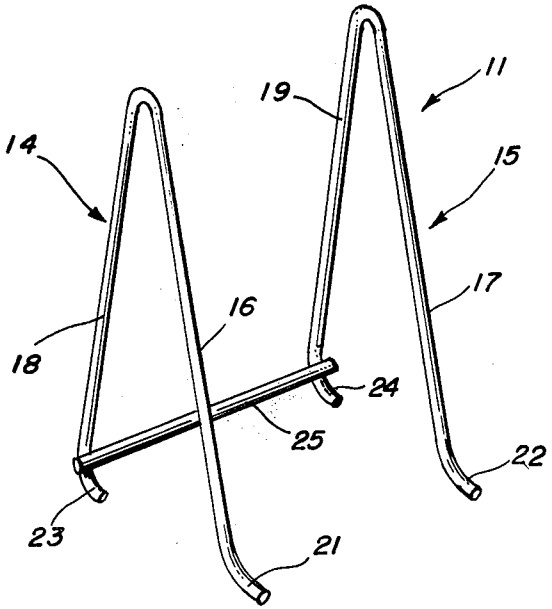
FIG. 4 is a front perspective view of the easel device made in accordance with this invention.

As best disclosed in FIGS. 4 and 5, the easel device 11 is preferably constructed of a pair of side inverted V-shaped wire members 14 and 15, including a pair of front legs 16 and 17 integrally joined, such as by bending, at their upper end portions with a corresponding pair of rear legs 18 and 19. The lower end portions of the legs 16 and 18 are spaced apart in a front-to-rear direction, while the lower end portions of the legs 17 and 19 are likewise spaced apart in a front-to-rear direction by the same amount as the lower portions of the legs 16 and 18.

The front legs 16 and 17 lie in substantially the same plane to define a front support member declining forward, in the operative upstanding position of the easel device 11, in order to support a planar article, such as a composition book 20 (FIGS. 1 and 5). The rear legs 18 and 19 likewise lie in a common plane, which is almost vertical, as illustrated in FIG. 5. Preferably, the side wire members 14 and 15 lie in parallel vertical planes which extend generally front-to-rear, when the device is in its operative position.

The lower end portions of the front legs 16 and 17 terminate in integral bent portions forming front peg elements 21 and 22 projecting generally forwardly. In a similar manner, the lower end portions of the rear legs 18 and 19 terminate in integral bent end portions to define rear peg elements 23 and 24 also projecting forwardly, but not as pronounced as the forward projection of the front peg elements 21 and 22.

In order to secure the two side wire frame members 14 and 15 together, an elongated transverse rod 25 is fixed, such as by welding, adjacent its end portions to the lower end portions of the respective rear legs 18 and 19.

The shelf panel 12 may be of relatively thin, molded, thermoplastic, sheet material, such as illustrated in the drawings, and adapted to be supported upon an existing shelf, such as the wooden shelf 27. The shelf panel 12 is perforated to include a plurality of peg-holes 28.

As disclosed in the drawings, these peg-holes 28 are preferably spaced transversely (widthwise) and longitudinally (front-to-rear) at uniform intervals, corresponding to the transverse and front-to-rear dimensions between the peg elements 21, 22, 23 and 24 of the easel device 11.

Projecting upwardly from the top surface 29 of the shelf panel 12 are a plurality of transversely extending elongated rib members 30, which reinforce the strength and structural stability of the shelf panel 12. However, those rib members 30', which are slightly spaced in front of the peg-holes 28', provide a barrier to prevent the planar articles, such as the composition books 20, from slipping forward when they lie against the front legs 16 and 17, in operative position, as best illustrated in FIG. 5.

Longitudinal grooves 31 are formed in the top surface 29 to define transversely spaced longitudinally extending, depending ridge members 32 having substantially coplanar bottom surfaces to rest upon the top surface of the subjacent supporting shelf 27. These ridge members 32 also function as reinforcing members for the shelf panel 12.

The opposing end portions of the shelf member 12 may be further provided with depending rectangular pads 33 to the bottom of which are secured double-adhesive strips 34 to be secured to the bottom bearing surfaces of the pads 33 and to the top surface of the shelf 27. Thus, where the shelf panels 12 are formed in sections, such as illustrated in FIG. 1, a plurality of sections 12 may be mounted upon a shelf 27, end-to-end, and each section is secured to the shelf 27 by the adhesive strips 34.

In order that the shelf panels 12 may be adapted to fit shelves 27 of different depths, each shelf panel 12 may be manufactured to have a depth, or front-to-rear dimension, corresponding to the maximum depth of a shelf adapted to support the shelf panel 12. A pluraity of transversely extending severance grooves or creases 36 having reduced thicknesses from the normal thickness of the panel 12 are formed in the rear portion of each panel 12 to extend its full width. These creases 36 may be located at distances from the front of the panel 12 corresponding to the depths of different size conventional shelves 27. Then if a shorter depth panel is desired, the rear portion of the panel 12 behind the corresponding crease 36 may be easily broken off manually so that the shelf panel 12 will fit that particular shelf 27.

The shelf panel 12 is preferably provided with a front flange 37, which preferably depends in front of the front edge of the shelf 27, to provide a stop for limiting the rearward movement of the shelf panel 12 along the shelf 27, and also to hide the front edge of the shelf 27 for decorative purposes. This front flange 37 may form the front wall of an inverted channel member 38, which may be molded into the panel 12.

If the shelf panel 12 is molded of thermoplastic material, then all of the rib members 30, ridge members 32, bearing pads 33, and severance grooves 36 may be molded simultaneously. The peg holes 28 may be drilled or otherwise formed, as desired.

In assembling the easel device 11 upon the shelf 12, the desired location of the planar article or composition book 20 is first ascertained, such as the phantom position illustrated in FIG. 1. The front peg elements 21 are then inserted into the corresponding pair of transversely spaced peg holes 28' until the forward projecting peg elements 21 and 22 have completely passed through the corresponding peg holes 28' to lie beneath the panel 12. If necessary, the rear legs 18 and 19 are manually moved or squeezed toward the front legs 16 and 17, by virtue of the semi-elasticity of the materials from which the legs are made, such as wire rods, until the rear peg elements 23 and 24 can pass through the corresponding rear peg holes 30. The peg elements 23 and 24 will penetrate the peg holes 30 until the transverse rod 25 bears against the top surface 29, in which position, the rear peg elements 23 and 24 will be completely below the bottom surface 39 of the panel 12, and the front peg elements 21 and 22 will bear upward against the bottom surface 39 of the shelf panel 12, as best disclosed in FIG. 5. The composition book 20 may then be laid against the front legs 16 and 17 defining the declining front support member, so that the bottom edge of the book 20 is received between the lower portions of the front legs 16 and 17 and the transverse rib member 30' spaced in front of the legs 16 and 17.

Of course, a plurality of easel devices 11 may be mounted on the panel 12 to support other composition books 20, or other substantially planar articles, in desired locations upon the shelf panel 12.

When it is desired to remove the book 20 from the shelf, or to transfer the book 20 to another part of the shelf, the easel device 11 may just as easily be removed from the corresponding peg holes 28 and 28'.

If desired, the shelf panel 12 might be made of sufficiently rigid material, so that with the appropriate support, it would constitute the entire shelf, so that no subjacent existing shelf 27 would be required.

It is also within the scope of this invention to utilize the easel devices 11 upon other types of shelf structures, so long as the shelf structures incorporate peg holes 28 and 28' of the required depth for receiving the respective peg elements 21–24 for securing the easel devices 11 to the shelves, in substantially the same manner as disclosed in FIGS. 1 and 5.

What is claimed is:

1. An easel device for a display shelf comprising:

(a) a display shelf member having a pre-determined thickness and having a plurality of peg-holes extending through said thickness of said shelf member, at least some of said peg-holes being uniformly spaced in a front-to-rear direction, said display shelf member having a substantially planar top surface, (b) a body member having an upper portion and including downward diverging front and rear support members each having front and rear end portions, respectively, (c) said front lower end portion being spaced forward of, and elastically yieldable relative to, said rear lower end portion, (d) said front lower end portion comprising at least one front peg element projecting forwardly of said front support member, and said rear lower end portion comprising at least one rear peg element, (e) said peg elements being adapted to depend through said corresponding front-to-rear spaced peg-holes to hold said body member in an upright operative position in which said front support member declines forward from said rear support member, (f) a plurality of transverse ribs projecting upward from the plane of said top surface, each of said transverse ribs being spaced a pre-determined distance in front of a corresponding peg hole through which said front peg element depends, to support the bottom edge of a planar article between said front support member and said corresponding transverse rib member while said planar article is supported in a rearward inclined position on said front support member.

2. The invention according to claim 1, in which said front and rear support members comprise integral wire members.

3. The invention according to claim 2 in which said integral wire members are a pair of integral wire members spaced transversely of the front-to-rear dimension of said body member.

4. The invention according to claim 3 further comprising an elongated transverse rod member fixed to the spaced portions of said wire members comprising said rear lower end portion.

5. The invention according to claim 4 in which said transverse rod member is adapted to engage said planar top surface, in operative position.

6. The invention according to claim 1 in which said shelf member comprises a plurality of transversely spaced longitudinally extending downward projecting ridge members having substantially coplanar bottom bearing surfaces for supporting said shelf member upon a planar shelf.

7. The invention according to claim 1 in which said shelf member comprises a plurality of downward projecting pad members having substantially coplanar bottom surfaces and adhesive means on said bottom surfaces for securing said shelf member to the top surface of a planar shelf.

8. The invention according to claim 1 in which said shelf member comprises at least one elongated severance groove extending the full width of said shelf member to facilitate separation of a portion of said shelf member to the rear of said severance groove, to permit said shelf member to fit upon an underlying shelf of corresponding depth.

* * * * *